US008038005B2

(12) United States Patent
Bruske et al.

(10) Patent No.: US 8,038,005 B2
(45) Date of Patent: Oct. 18, 2011

(54) FELTING NEEDLE PACKAGE

(75) Inventors: Johannes Bruske, Albstadt (DE); Hans Häussler, Oporto (PT); Stefan Drope, Albstadt (DE); Hans-Joachim Halamoda, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 78 days.

(21) Appl. No.: 12/469,560

(22) Filed: May 20, 2009

(65) Prior Publication Data

US 2009/0288975 A1 Nov. 26, 2009

(30) Foreign Application Priority Data

May 21, 2008 (EP) ..... 08156671

(51) Int. Cl.
*B65D 85/24* (2006.01)

(52) U.S. Cl. ..... 206/380; 206/443; 206/204

(58) Field of Classification Search ..... 206/380, 206/443, 342, 317, 204; 220/501, 553, 555, 220/529, 532
See application file for complete search history.

(56) References Cited

U.S. PATENT DOCUMENTS

| | | | | |
|---|---|---|---|---|
| 1,674,352 | A * | 6/1928 | Adams | 206/317 |
| 1,799,776 | A * | 4/1931 | Boden | 206/380 |
| 2,417,331 | A * | 3/1947 | Taylor et al. | 206/317 |
| 3,410,391 | A * | 11/1968 | Kanter | 206/1.5 |
| 3,491,909 | A * | 1/1970 | Ikelheimer | 220/533 |
| 3,758,020 | A * | 9/1973 | Childs et al. | 206/422 |
| 5,366,083 | A | 11/1994 | Sos et al. | |
| 7,798,325 | B2 * | 9/2010 | Wizemann et al. | 206/380 |
| 2003/0127349 | A1 * | 7/2003 | Faller et al. | 206/380 |
| 2004/0211822 | A1 | 10/2004 | Lin | |
| 2006/3124712 | | 6/2006 | Weimer, Jr. | |
| 2006/0191984 | A1 * | 8/2006 | Hitosugi | 229/112 |
| 2007/0023308 | A1 | 2/2007 | Wizemann et al. | |

FOREIGN PATENT DOCUMENTS

| | | |
|---|---|---|
| CN | 1422224 | 6/2001 |
| CN | 201031017 | 3/2008 |
| DE | 92 09 580 U1 | 11/1992 |
| DE | 10 2005 036329 | 2/2007 |
| FR | 1 157 155 | 5/1958 |
| JP | 1130969 | 9/1989 |
| KR | 2020060000132 | 12/2006 |
| RU | 50521 | 1/2006 |
| SU | 1406060 | 6/1988 |
| SU | 1745622 | 7/1992 |
| WO | 0220361 | 3/2002 |
| WO | WO02/059016 | 8/2002 |

* cited by examiner

*Primary Examiner* — J. Gregory Pickett
(74) *Attorney, Agent, or Firm* — Fitch Even Tabin & Flannery; Norman N. Kunitz

(57) ABSTRACT

A felting needle package (1) in accordance with the invention consists of a case having the shape of a parallelepiped, said case's interior space being divided by a dividing wall (11), said wall extending diagonally with respect to the lateral walls but extending at a right angle with respect to the bottom (10). The dividing wall (11) may have one or more interruptions such as, for example openings for grasping. Additional dividing walls may be provided. In plan view, the dividing walls divide wedge-shaped, i.e., prism-shaped, partial spaces in the package, said partial spaces being disposed to accommodate felting needle bundles that are also wedge-shaped.

11 Claims, 3 Drawing Sheets

FELTING NEEDLE PACKAGE

CROSS-REFERENCE TO RELATED APPLICATION

This application claims the benefit of foreign priority under 35 U.S.C. §119 based on European 08 156 671.3, filed May 21, 2008, the entire disclosure of which application is hereby incorporated by reference.

BACKGROUND OF THE INVENTION

The invention relates to felting needle packages. Felting needles are required in very large numbers by felt manufacturers. Felting needles are components that are supply materials subject to wear and that are purchased to be stored for ready availability for use as needed. In so doing, needle manufacturers have to address the problem of packaging felting needles in an economical way in such a manner that the packages are not damaged, even when they are roughly handled and kept in long-term storage. However, in so doing, said needles are also supposed to be packaged in such a manner that the user can easily remove the felting needles from the package. This means, that the risks of injury are to be minimized.

The felting needles have an elongated working part and a holding part with an angled foot, said holding part being an extension of said working part. As a rule, the working parts have a smaller diameter than the holding parts. If the felting needles are arranged side by side and oriented parallel to each other, as well as compressed, a wedge-shaped bundle is being created.

In accordance with this, document DE 10 2005 036 329 A1 suggests wedge-shaped needle packages that can hold the felting needle in an ordered manner. The wedge-shaped package may be set in a rectangular outer package. In conjunction with this, said publication also suggests the arrangement of two wedges-shaped packages aligned in opposite direction in the space inside the outer package in order to better utilize the inside space. The remaining hollow spaces of the out package are filled with foam material elements or the like.

Other packages have been known, for example, from sewing needles. Regarding this, reference is made to publication WO 02/059016, said reference showing a flat, rectangular needle package. Said package consists of a box that can be folded open and that has clamping lips diagonally arranged on said lid. These clamping lips are intended to press the sewing needles against the bottom of the package in order to fix said needles in position in the package.

Considering this, it is the object of the invention to create a space-saving felting needle package that is designed in a simple and neat manner and that can be easily handled by the manufacturer of the needle as well as by the user of the needle.

SUMMARY OF THE INVENTION

The above object generally is achieved with a felting needle package in accordance with the invention that comprises a container with a bottom and walls rising therefrom, with the walls, together with a lid, enclosing the interior space for the accommodation of felting needles. Arranged inside the interior space is at least one dividing wall that is aligned at an acute angle with respect to the lateral walls. This dividing wall divides the interior space of the container into two or more accommodation sections for the felting needles, said sections having approximately the same size. Viewed from the top, i.e., looking into the container, this dividing wall is arranged approximately diagonally between two of the four corners. The height of the dividing wall may essentially be equal to the height of the container or may also be slightly smaller. Due to the diagonally arranged dividing wall, the interior space of the container is divided into several, essentially wedge-shaped compartments, whereby the wedge shape may be adapted to the taper of the felting needles.

Considering the felting needle package in accordance with the invention, the felting needles are preferably oriented in the same direction in the respectively divided section in the interior space. The working parts of the needles of the respective compartment point in a first direction. The holding parts point into a second, opposite direction. The needles of the bundle of needles of the other accommodation section divided by the dividing wall are preferably oriented in the opposite direction.

Preferably, the dividing wall is provided with at least one cutout that is centered, for example, and may extend from the upper edge of said wall to the bottom. This cutout or also a smaller cutout facilitates the removal of the felting needles from the package and encourages the user to grasp the needles in the center. This reduces the risk of injury when touching the frequently extremely sharp or sharp-edged working parts, because these working parts are located in the end region of the needles.

If required, an additional component, for example, configured as a bracket, can be set into the container in order to shorten the accommodation space at it respective tip. This measure may be utilized, for example, for an adaptation to shorter needles.

Preferably, the dividing wall is connected at least with the lateral wall and/or the bottom, and further preferably, also with the lateral wall and the bottom, thus providing a stable positioning of the dividing wall in the container. In individual cases, it may also be expedient to connect the dividing wall with the bottom or only with the lateral wall in order to achieve flexibility in the one or the other bending direction.

The diving wall and/or the bracket may be connected in one piece and seamlessly with the container, its bottom and/or at least one wall of said container. In this case, the container is made of one piece.

Preferably, the container and its lid consist of the same plastic material. Also, the dividing wall preferably consists of the same plastic material and is connected, for example, in one piece and seamlessly with the remaining container. The aforementioned bracket or any other insert part preferably also consists of the same plastic material. This measure encourages recycling. Preferably, the container and its lid consist of easily recyclable plastic material such as, for example, polystyrene or ABS.

Preferably, the lid is designed as a multi-function lid. Thus, it may adjoin an angle joint on the container, along which the container and the lid come into engagement with each other along the container edge. In order to improve the seal, a soft gasket may be integrated in the lid or also in the upper edge of the container. A separate strip of adhesive tape around the outside of the container may be omitted.

The lid can be locked in engagement with the edge of the container. Preferably, it is possible to provide detent means or clips that may only be opened by destruction. Then, the clip closure acts as the original seal.

It is possible to provide a reservoir with rust inhibitor. This reservoir may be provided in the lid or, alternatively, also at another location in the container. Preferably, the depot is a rust inhibitor in a form that is suitable for automation. For example, it may be provided in the form of tablets, in the form of a gel or in the form of small powder sachets, impregnated paper, pieces of cardboard or felt, etc. Preferably, the reservoir is connected to the parts of the lid or the container by adhesion only, in order to be removable prior to recycling.

Although the container has the exterior shape of a parallelepiped, its interior space is divided into wedge-shaped chambers. The number of chambers is two or greater. The base area of the chamber may have the form of a triangle or trapeze (triangle with cut off tip), whereby the chambers are formed by one or more dividing walls in the interior space of the container that is open toward the top. The dividing walls, like the lateral walls of the container, preferably extend perpendicular to, i.e., at a right angle, the bottom.

A spring fastened in the lid may be used to hold the needles in place. This spring may be a plate or strip of plastic material, or an otherwise similar element whose one end or preferably both ends are braced against the lid, said plate or strip bulging toward the needles, i.e., into the interior space of the container.

Furthermore, ribs or other projections may be provided on the walls of the container and/or on its bottom in order to permit a good abutment of the needles in the container.

Additional details of advantageous embodiments of the invention are the subject matter of the drawing, the description and the claims. The description is restricted to essential aspects of the invention and miscellaneous aspects. The drawings disclose additional details and are to be referred to as being supplementary.

DETAILED DESCRIPTION OF THE INVENTION

Figure 1:
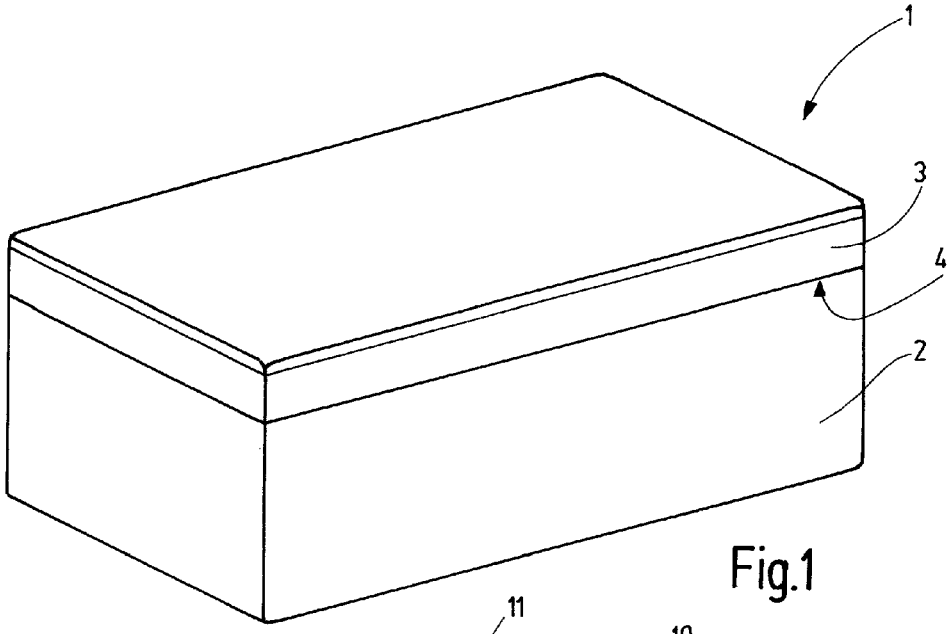
FIG. 1 is a perspective illustration of a felting needle package in closed state.

FIG. 1 shows a felting needle package 1 that is configured as a rectangular case. It comprises a container 2 and a lid 3 for closing the container 2 toward the top. The lid 3 and the container 2 abut against each other along a dividing joint 4.

Figure 2:
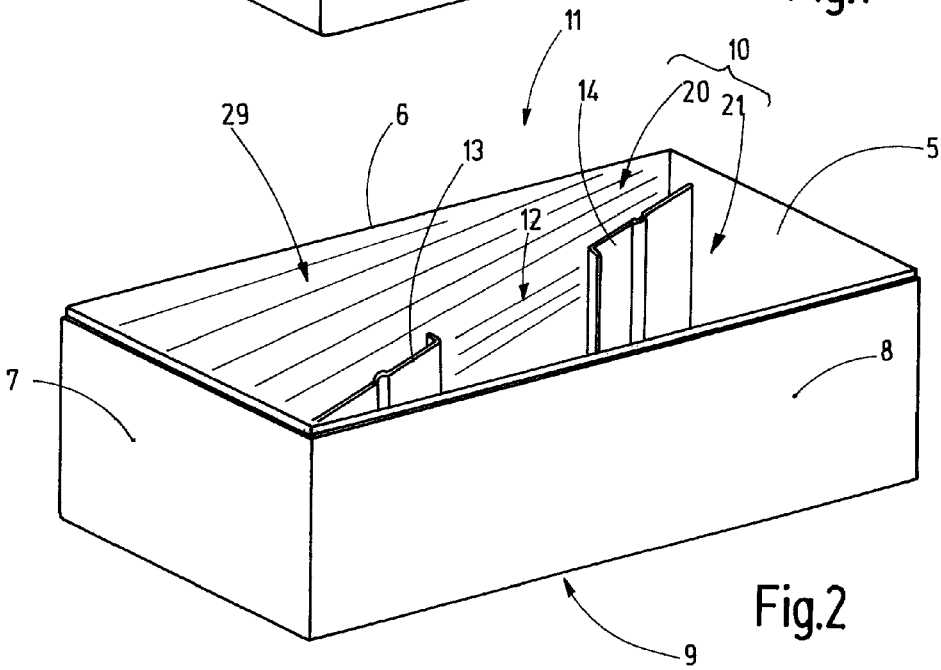
FIG. 2 is a perspective view of the felting needle package in accordance with FIG. 1, with the lid removed.
Figure 5:
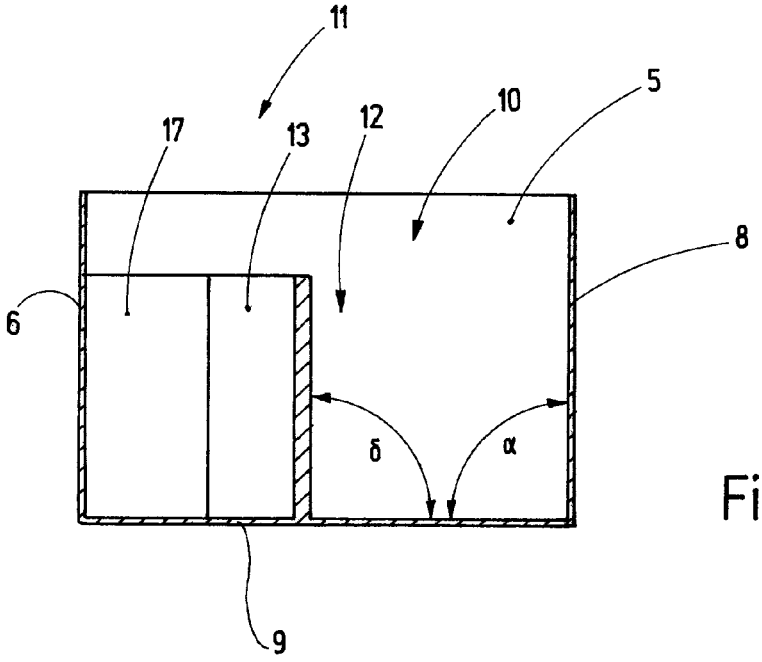
FIG. 5 is a sectional view, along line V-V in accordance with FIG. 4, of the container in accordance with FIG. 4.

FIG. 2 shows the container 2 in greater detail. It comprises four lateral walls 5, 6, 7, 8 that delimit a rectangular interior space. Preferably, said walls extend at a 90° angle from the bottom 9 up. For example, the corresponding 90° angle $\alpha$ is shown in FIG. 5. The bottom 9 and each of the lateral walls 5, 6, 7, 8 are rectangular, thin, preferably essentially flat, plate-shaped elements that consist of the same material and abut against each other in a gapless and seamless manner along their edges. The container 2, for example, may consist of an injection-molded part of plastic material. Preferably, said element consists of a recyclable plastic material.

The interior space 10 that is enclosed by the container 2 is diagonally divided by a dividing wall 11. The dividing wall 11 preferably is a one-piece component of the container 2. In this case, again, said dividing wall is connected in a gapless and seamless manner with the bottom 9 as well as with one of the lateral walls 5, 6, 7, 8. The dividing wall 11 may be provided with a central opening 12 that extends through to the bottom 9 and thus divides said dividing wall into two dividing wall sections 13, 14. Preferably, they are in alignment with each other and thus are located essentially on a common plane or (see FIG. 4) on a common line. This plane or line intersects opposing lateral walls 5, 7 and is located at least close to the diagonal of the rectangle described by the bottom 9. Accordingly, the dividing wall 11 and the dividing wall section 13 adjoin the smaller lateral wall 7. Similarly, this applies to the dividing wall section 14 that adjoins the smaller lateral wall 5. Preferably, the larger lateral walls 6, 8 do not have adjoining dividing walls. Together, the dividing wall section 13 and the lateral wall 7 subtend an angle $\beta$ that is smaller than 90°. The long lateral wall 8 and the dividing wall section 13 also subtend an angle $\gamma$ that is smaller than 90°. The sum of the two angles $\beta$ and $\gamma$ is 90°. The dividing wall 11 as a whole and, in particular, the dividing wall section 14 or 13, and the bottom 9 subtend a right angle $\delta$ (see FIG. 5).

The essentially flat dividing wall section 13 may be provided on its edge facing the opening 12 with an angled edge 15 that increases the stiffness of the dividing wall section 13. In addition, the dividing wall section 13 may be provided on its edge 15 with a parallel bead 16 that defines a groove facing the long lateral wall 6, 8. This groove may be used for the accommodation of a filler piece 17 that may be configured as a bracket, for example. Together, its two sections 18, 19 that preferably have the same geometric configuration and/or length subtend a right angle. The filler piece 17 may be inserted from the top into the intermediate space between the dividing wall section 13 and the long lateral wall 8, whereby the face of the section 18 moves into the bead, and a flat side of the section 19 abuts against the lateral wall 8.

Figure 4:
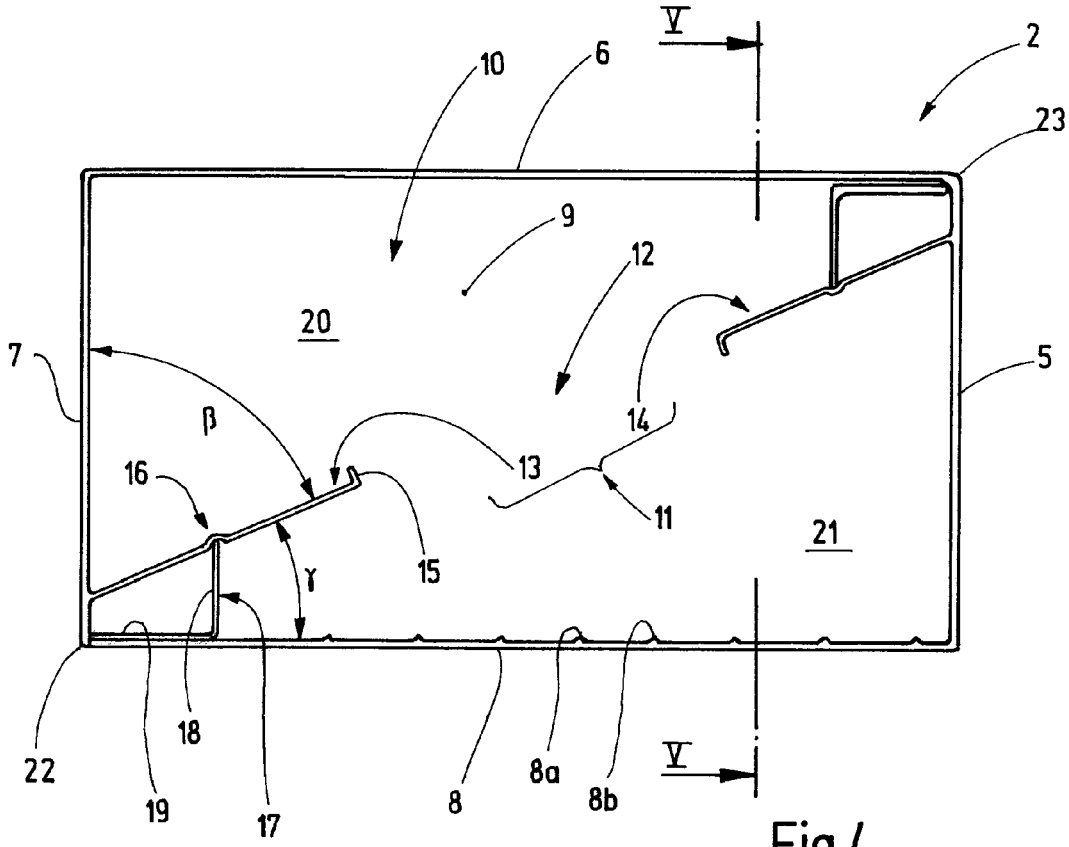
FIG. 4 is a schematic plan view of the container of the felting needle package in accordance with FIG. 2.

As shown by FIG. 4, the dividing wall 11 divides the interior space 10 into two interior space sections 20, 21. Each of these has an approximately triangular base area. If the dividing wall 11 adjoins the corners 22, 23, the respective interior space section 20, 21 is exactly triangular. Other than that, said interior space section has the shape of a trapeze. Its length may be varied with the filler piece 17 in order to accomplish an adaptation to felting needles of various lengths.

Figure 3:
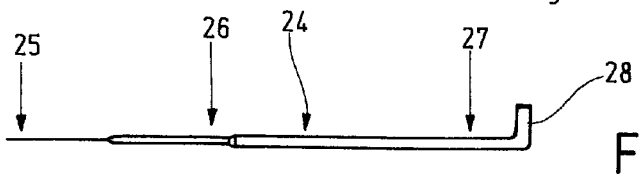
FIG. 3 is a schematic side view of a felting needle out of the package in accordance with FIG. 1 or 2.

FIG. 3 shows a felting needle 24 of the type that is to be accommodated in a large number by the felting needle package. Said felting needle has a working part 25 with a tip on one end and has a thicker shank 26 that adjoins the working part 25 in a straight extension on the opposite end, and has a holding part 27 that, in turn, adjoins the shank 26 in a straight extension, however, does have a greater thickness than the shank 26. The end of the holding part 27 may be angled in order to form a foot 28. When placed next to each other side by side, such felting needles form a wedge-shaped bundle 29. In FIG. 2, such a bundle is schematically indicated simply by a few lines. The bundle 29 mostly fills the interior space section 20. The interior space section 21 may accommodate an oppositely oriented, likewise wedge-shaped, bundle of felting needles 24, this not being shown in detail in FIG. 2, however.

Figure 6:
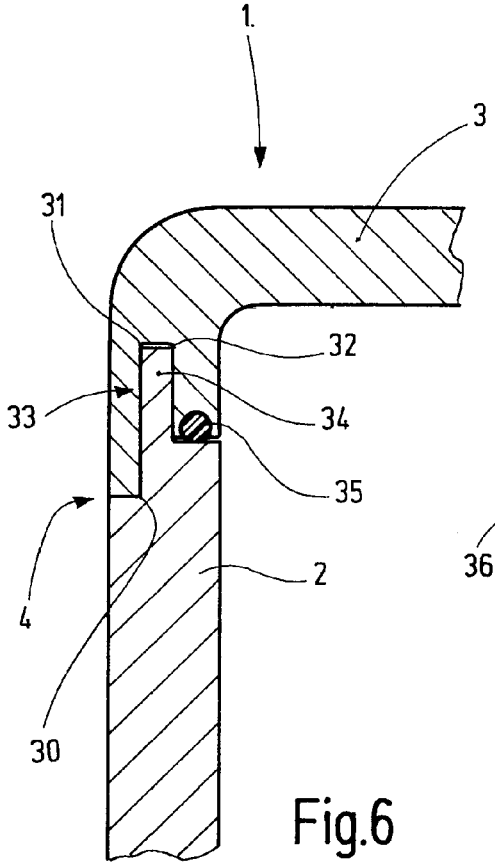
FIGS. 6 and 7 are sectional views along the joint between the lid and the container, of the felting needle package in two different positions.
Figure 7:
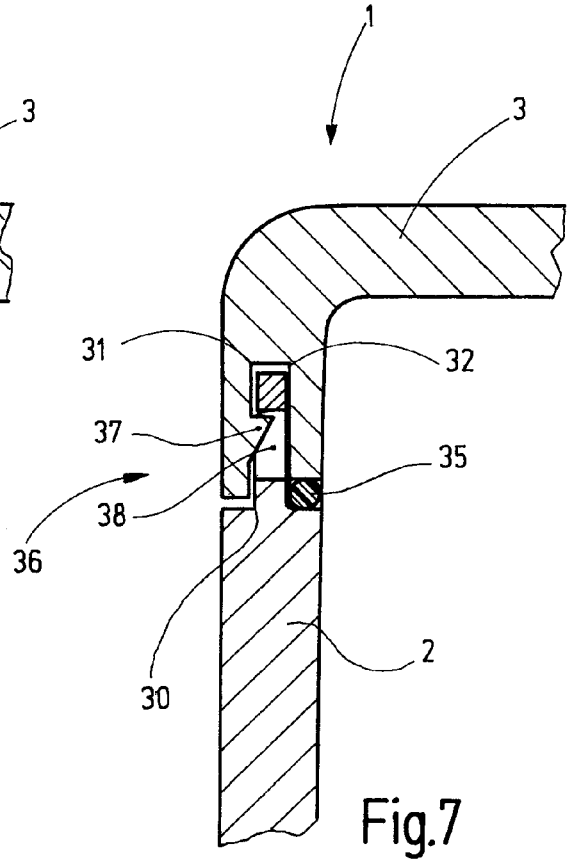

The connection between the lid 3 and the container 2 of the felting needle package 1 is preferably moisture-proof. For this, the dividing joint 4 may be configured, in particular, as an angle joint, as illustrated by FIGS. 6 and 7. This means that the joint comprises several surfaces, each subtending an angle on at least one, preferably on several, lines 30, 31. Consequently, the lid 3 may have a groove 33, for example, into which extends an edge projection 34 of the container 2. At a suitable point, the lid 3 or, alternatively, also the container 2, may be provided with a peripheral gasket 35 along the dividing joint 4, as shown schematically in FIGS. 6 and 7. The gasket 35 may be placed, injected or otherwise fastened in a recess of the container 2 or of the lid 3. The gasket may consist of an elastomer or also of an adhesive material that produces a moisture-resistant connection between the lid 3 and the container 2.

Furthermore, FIG. 7 shows that a detent means 36 may be effective between the lid 3 and the container 2. This means, is formed, for example, by somewhat elastically resilient means that come into engagement with each other. These may be, for example, a projection 37 provided on the lid 3 and an associate detent opening 38 in the edge projection 34. Preferably, this detent means 36 extends only over the sections of the peripheral edge of the container 2 and the lid 3, respectively.

Figure 8:
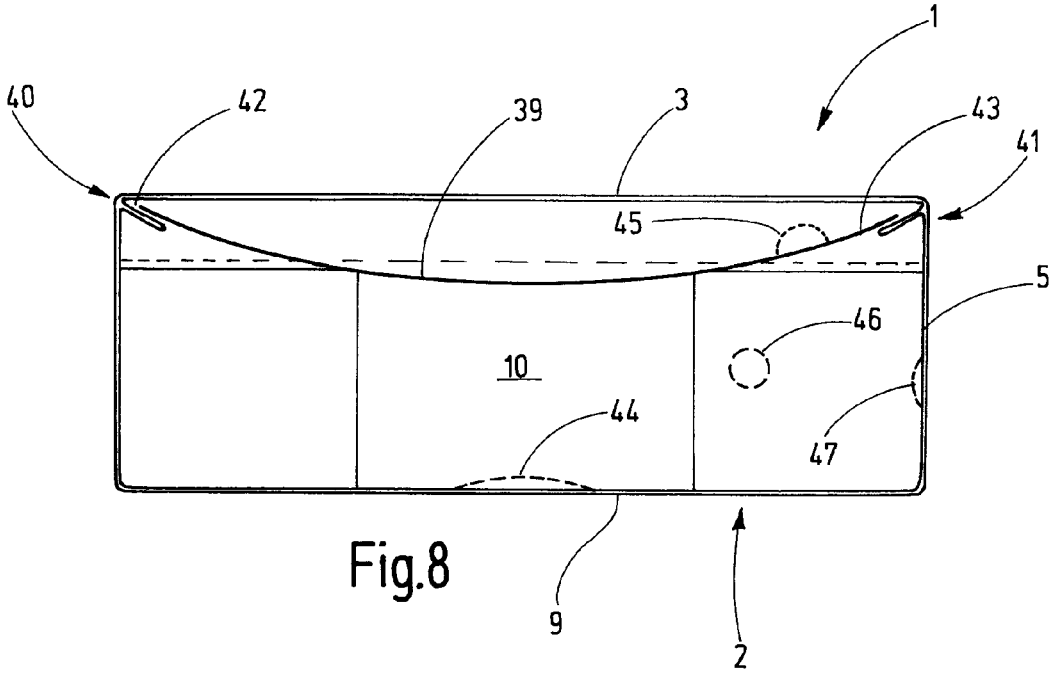
FIG. 8 shows the needle package in accordance with FIG. 1, vertically in section, in a modified embodiment.

As shown by the Figures, the lid 3 may be configured as a simple hooded lid whose function is simply to close the interior space 10. However, said lid may fulfill other and additional functions, for example, the function of holding the felting needles 24 in place. As shown by FIG. 8, this is achieved by providing a spring element 39 on the lid 3. This spring element may be a strip of plastic material that more or less takes up the width of said lid and, for example, extends from one narrow-sided end 40 to the oppositely located narrow-sided end 41. The ends 42, 43 of the spring element 39 may be seated in corresponding pockets located on the inside of the lid 3, said spring elements abutting against said pockets. For example, the spring element 39 is a flexion spring that curves forward so as to protrude into the interior space 10. It is possible for the spring element 39 to be loosely shifted in longitudinal direction with both ends in the receiving pockets, or to be supported by other support means. Furthermore, on one end, the spring element 39 may be permanently connected to the lid 3, while the element's other end is free.

The interior space 10 may be provided at one or more points with various reservoirs 44, 45, 46, 47 of a rust inhibitor, preservative or other means that are intended to act on the felting needles 24 while said needles are being stored. These reservoirs are preferably arranged on the bottom 9, on one of the lateral walls, for example, the lateral wall 5, on the separating wall 11, on the lid 3 and/or on the spring element 39 or at other points in the interior space 10 of the felting needle package 1 in such a manner that they may be removed, if necessary, in order to be able to transfer the felting needle package 1 to plastics recycling.

The felting needle package 1 is used as follows:

For loading, each of the interior space sections 21, 22 is filled with a bundle 29 consisting of felting needles 24. They may be provided with a paper tape, for example, or also be loosely filled. In so doing, the bundle 29 and the not specifically illustrated other bundle are oriented in opposing directions. Once this has been done, the lid 3 is closed. In so doing, it locks the container 2 and thus hermetically seals the felting needles 24 against the outside.

The felting needles 24 are tightly packed in the box. Inasmuch as they are in contact with each other along their flanks, their sharp ends of the work parts 25 preferably do not abut against the exterior wall 5 or 7. In addition, the filler piece 17 may provide an additional protection of the working parts 25 of the felting needles 24. As is obvious from FIG. 4, the container 2 may additionally be provided, for example, along the inside of its lateral walls, with ribs or other projections 8*a*, 8*b* that improve the support of the felting needles.

The felting needle package 1 may be shipped and stored in closed state. When needed, said package is opened, whereby the detent means 36 need to be overcome. Preferably, they are designed in such a manner that they experience a certain kind of destruction, so that the felting needle package 1 can no longer be permanently firmly closed. This is used to verify that the original seal is intact. Now the felting needles 24 may be removed individually or in bundles. The opening 12 facilitates the removal from the interior space 10.

A felting needle package 1 in accordance with the invention consists of a case having the shape of a parallelepiped, said case's interior space being divided by a dividing wall 11, said wall extending diagonally with respect to the lateral walls but extending at a right angle with respect to the bottom 10. The dividing wall 11 may have one or more interruptions such as, for example openings for grasping. Additional dividing walls may be provided. In plan view, the dividing walls divide wedge-shaped, i.e., prism-shaped, partial spaces in the package, said partial spaces being disposed to accommodate felting needle bundles that are also wedge-shaped.

It will be appreciated that the above description of the present invention is susceptible to various modifications, changes and modifications, and the same are intended to be comprehended within the meaning and range of equivalents of the appended claims.

LIST OF REFERENCE NUMERALS

1 Felting needle package
2 Container
3 Lid
4 Dividing joint
5, 6, 7, 8 Lateral walls
8*a*, 8*b* Projections, ribs
9 Bottom
α Angle
10 Interior space
11 Dividing wall
12 Opening
13, 14 Dividing wall sections
β, γ, δ Angle
15 Edge
16 Groove
17 Filler piece
18, 19 Sections
20, 21 Interior space sections, needle accommodation space, chambers
22, 23 Corners
24 Felting needle
25 Working part
26 Shank
27 Holding part
28 Foot
29 Bundle
30, 31, 32 Lines
33 Groove
34 Edge projection
35 Gasket
36 Detent means
37 Detent projection
38 Detent opening
39 Spring element, downholder
40, 41, 42, 43 Ends
44, 45, 46, 47 Reservoirs

What is claimed is:

1. Felting needle package, comprising:

a container having a bottom and walls extending upward from the bottom , said walls, together with a lid, enclosing an interior space containing a plurality of individual felting needles , and at least one dividing wall oriented perpendicular to said bottom and at an acute angle (β) with respect to an adjacent lateral wall and arranged in the interior space, said dividing wall being connected with the bottom and with at least one lateral wall to form at least one needle containing wedge-shaped chamber on each of the two sides of the dividing wall, with each said chamber being delimited by a lateral wall on one side and by the dividing wall on the opposite side, and said dividing wall having at least one cutout extending from an upper edge thereof toward said bottom to facilitate removal of an individual felting needle from one of said wedge shaped chambers.

2. Felting needle package in accordance with claim 1, wherein the bottom has a rectangular shape.

3. Felting needle package in accordance with claim 1, wherein each of the lateral walls subtends a right angle (α) with the bottom.

4. Felting needle package in accordance with claim 1, wherein the dividing wall extends from one corner where two lateral walls abut against each other, or from a region of a lateral wall close to a corner, starting from the opposing corner or the lateral wall.

5. Felting needle package in accordance with claim 1, wherein the cutout is arranged in a central section of the dividing wall and extends to said bottom.

6. Felting needle package in accordance with claim 1, wherein the lid is connected with the lateral walls via an angle joint.

7. Felting needle package in accordance with claim 1, wherein the lid and the lateral walls are connected with each other via at least one detent means.

8. Felting needle package in accordance with claim 1, wherein the lid and/or the lateral walls are connected with an integrated gasket.

9. Felting needle package in accordance with claim 1, wherein a reservoir of a treatment agent or preservative is located in the lid and/or on the bottom and/or on the lateral walls and/or on the dividing wall.

10. Felting needle package in accordance with claim 1, wherein a downholder is provided on the lid.

11. Felting needle package in accordance with claim 10, wherein the downholder consists of a bending spring with two ends, both of said ends being braced against the lid.

* * * * *